US009783876B2

(12) United States Patent
Nakatsuka et al.

(10) Patent No.: US 9,783,876 B2
(45) Date of Patent: Oct. 10, 2017

(54) STAINLESS STEEL FOR OIL WELLS AND STAINLESS STEEL PIPE FOR OIL WELLS

(71) Applicant: NIPPON STEEL & SUMITOMO METAL CORPORATION, Tokyo (JP)

(72) Inventors: Shinjiro Nakatsuka, Tokyo (JP); Taro Ohe, Tokyo (JP); Hisashi Amaya, Tokyo (JP); Hideki Takabe, Tokyo (JP); Yohei Otome, Tokyo (JP); Yusaku Tomio, Tokyo (JP); Masanao Seo, Tokyo (JP); Tomohiko Omura, Tokyo (JP); Kunio Kondo, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 490 days.

(21) Appl. No.: 14/387,261

(22) PCT Filed: Feb. 27, 2013

(86) PCT No.: PCT/JP2013/055219
§ 371 (c)(1),
(2) Date: Sep. 23, 2014

(87) PCT Pub. No.: WO2013/146046
PCT Pub. Date: Oct. 3, 2013

(65) Prior Publication Data

US 2015/0047831 A1 Feb. 19, 2015

(30) Foreign Application Priority Data

Mar. 26, 2012 (JP) ..... 2012-068598

(51) Int. Cl.

| | |
|---|---|
| ***C22C 38/42*** | (2006.01) |
| ***C22C 38/44*** | (2006.01) |
| ***C22C 38/52*** | (2006.01) |
| ***C22C 38/50*** | (2006.01) |
| ***C22C 38/48*** | (2006.01) |
| ***C22C 38/46*** | (2006.01) |
| ***C22C 38/54*** | (2006.01) |
| ***C22C 38/00*** | (2006.01) |
| ***C21D 9/08*** | (2006.01) |
| ***C22C 38/02*** | (2006.01) |
| ***C22C 38/04*** | (2006.01) |
| ***C22C 38/06*** | (2006.01) |
| ***C21D 6/00*** | (2006.01) |
| ***E21B 17/00*** | (2006.01) |

(52) U.S. Cl.

CPC ..... *C22C 38/001* (2013.01); *C21D 6/002* (2013.01); *C21D 6/004* (2013.01); *C21D 9/08* (2013.01); *C22C 38/002* (2013.01); *C22C 38/004* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *E21B 17/00* (2013.01); *C21D 2211/005* (2013.01); *C21D 2211/008* (2013.01); *C22C 38/005* (2013.01)

(58) Field of Classification Search
None
See application file for complete search history.

(56) References Cited

U.S. PATENT DOCUMENTS

2006/0243354 A1* 11/2006 Kimura ..... C21D 1/25 148/592

FOREIGN PATENT DOCUMENTS

| | | |
|---|---|---|
| CA | 2123470 | 11/1994 |
| CA | 2762899 | 12/2010 |
| CN | 1571861 | 1/2005 |
| JP | 2002-004009 | 1/2002 |
| JP | 2005-336595 | 12/2005 |
| JP | 2006-016637 | 1/2006 |
| JP | 2007-009321 | 1/2007 |
| JP | 2007-277639 | 10/2007 |
| JP | 2007-332442 | 12/2007 |
| JP | 2008-050646 | 3/2008 |
| WO | 2009/119048 | 10/2009 |
| WO | 2010/050519 | 5/2010 |
| WO | 2010/134498 | 11/2010 |
| WO | 2011/136175 | 11/2011 |

OTHER PUBLICATIONS

Key to Steel, 10th Edition 1974, Verlag Stahlschlussel , West Germany.*

* cited by examiner

*Primary Examiner* — Deborah Yee
(74) *Attorney, Agent, or Firm* — Clark & Brody

(57) ABSTRACT

A stainless steel for oil wells which has excellent high-temperature corrosion resistance and can stably obtain a strength of not less than 758 MPa is provided. The stainless steel for oil wells contains, by masse, C: not more than 0.05%, Si: not more than 1.0%, Mn: 0.01 to 1.0%, P: not more than 0.05%, S: less than 0.002%, Cr: 16 to 18%, Mo: 1.8 to 3%, Cu: 1.0 to 3.5%, Ni: 3.0 to 5.5%, Co: 0.01 to 1.0%, Al: 0.001 to 0.1%, O: not more than 0.05%, and N: not more than 0.05%, the balance being Fe and impurities, and satisfies Formulas (1) and (2):

$$Cr+4Ni+3Mo+2Cu \geq 44 \quad (1)$$

$$Cr+3Ni+4Mo+2Cu/3 \leq 46 \quad (2)$$

where each symbol of element in Formulas (1) and (2) is substituted by the content (mass %) of a corresponding element.

15 Claims, No Drawings

STAINLESS STEEL FOR OIL WELLS AND STAINLESS STEEL PIPE FOR OIL WELLS

TECHNICAL FIELD

The present invention relates to a stainless steel for oil wells and a stainless steel pipe for oil wells, and more particularly to a stainless steel for oil wells and a stainless steel pipe for oil wells, which are used in a high-temperature oil well environment and gas well environment (hereinafter, referred to as a high-temperature environment).

BACKGROUND ART

In the present description, an oil well and a gas well are collectively referred to simply as "an oil well". Accordingly, "a stainless steel for oil wells" as used herein includes a stainless steel for oil wells and a stainless steel for gas well. Also "a stainless steel pipe for oil wells" includes a stainless steel pipe for oil wells and a stainless steel pipe for gas well.

As used herein, the term "a high temperature" means, unless otherwise stated, a temperature not less than 150° C. Also as used herein, the symbol "%" relating to a chemical element means, unless otherwise stated, "mass %".

A conventional oil well environment contains carbon dioxide gas ($CO_2$) and/or chlorine ion ($Cl^-$). For that reason, in a conventional oil well environment, a martensitic stainless steel containing 13% of Cr (hereafter, referred to as a "13% Cr steel") is commonly used. The 13% Cr steel is excellent in carbonic-acid gas corrosion resistance.

Recently, the development of deep oil wells has advanced. A deep oil well has a high-temperature environment. Such high-temperature environment includes carbon dioxide gas or carbon dioxide gas and hydrogen sulfide gas. These gases are corrosive gases. Therefore, steel for oil wells to be used in deep oil wells is required to have a higher strength and a higher corrosion resistance than those of the 13% Cr steel.

The Cr content of a two-phase stainless steel is greater than that of the 13% Cr steel. Therefore, a two-phase stainless steel has a higher strength and a higher corrosion resistance than those of the 13% Cr steel. The two-phase stainless steel is, for example, a 22% Cr steel containing 22% of Cr, and a 25% Cr steel containing 25% of Cr. Although the two-phase stainless steel has a high strength and a high corrosion resistance, it includes many alloy elements, and therefore is expensive.

JP2002-4009A, JP2005-336595A, JP2006-16637A, JP2007-332442A, WO2010/050519, and WO2010/134498 propose stainless steels other than the above described two-phase stainless steel. The stainless steels disclosed in these literatures contain at the maximum 17 to 18.5% of Cr.

JP2002-4009A proposes a martensitic stainless steel for oil wells, which has a yield strength of not less than 860 MPa and a carbonic-acid gas corrosion resistance in a high-temperature environment. The chemical composition of the stainless steel disclosed in this literature contains 11.0 to 17.0% of Cr and 2.0 to 7.0% of Ni, and further satisfies: $Cr+Mo+0.3\,Si-40C-10N-Ni-0.3Mn\leq 10$. The metal micro-structure of this stainless steel is predominantly made up of martensite, and contains not more than 10% of a retained austenite.

JP2005-336595A proposes a stainless steel pipe which has a high strength and carbonic-acid gas corrosion resistance in a high-temperature environment of 230° C. The chemical composition of the stainless steel pipe disclosed in this literature contains 15.5 to 18% of Cr, 1.5 to 5% of Ni, and 1 to 3.5% of Mo, satisfies $Cr+0.65Ni+0.6Mo+0.55Cu-20C\geq 19.5$ and also satisfies $Cr+Mo+0.3Si-43.5C-0.4Mn-Ni-0.3Cu-9N\geq 11.5$.

The metal micro-structure of this stainless steel pipe contains 10 to 60% of a ferrite phase, and not more than 30% of an austenite phase, the balance being a martensite phase.

JP 2006-16637A proposes a stainless steel pipe which has a high strength and carbonic-acid gas corrosion resistance in a high-temperature environment of more than 170° C. The chemical composition of the stainless steel pipe disclosed in this literature contains 15.5 to 18.5% of Cr, and 1.5 to 5% of Ni, satisfies $Cr+0.65\,Ni+0.6\,Mo+0.55Cu-20C\geq 18.0$ and also satisfies $Cr+Mo+0.3Si-43.5C-0.4Mn-Ni-0.3Cu-9N\geq 11.5$. The metal micro-structure of this stainless steel pipe may or may not include an austenite phase.

JP 2007-332442A proposes a stainless steel pipe which has a high strength of not less than 965 MPa, and a carbonic-acid gas corrosion resistance in a high-temperature environment exceeding 170° C. The chemical composition of the stainless steel pipe disclosed in this literature contains, by mass %, 14.0 to 18.0% of Cr, 5.0 to 8.0% of Ni, 1.5 to 3.5% of Mo, and 0.5 to 3.5% Cu, and satisfies $Cr+2\,Ni+1.1\,Mo+0.7\,Cu\leq 32.5$. The metal micro-structure of this stainless steel pipe contains 3 to 15% of an austenite phase, the balance being a martensite phase.

WO2010/050519 proposes a stainless pipe which has a sufficient corrosion resistance even in a high-temperature carbon dioxide environment of 200° C., and further has a sufficient sulfide stress-corrosion cracking resistance even when the environment temperature of an oil well or gas well declines due to a temporary suspension of the collection of crude oil or gas. The chemical composition of the stainless steel pipe disclosed in this literature contains more than 16% and not more than 18% of Cr, more than 2% and not more than 3% of Mo, not less than 1% and not more than 3.5% of Cu, and not less than 3% and less than 5% of Ni, while Mn and N satisfy $[Mn]\times([N]-0.0045)\leq 0.001$. The metal micro-structure of this stainless steel pipe contains 10 to 40% by volume fraction of a ferrite phase, and not more than 10% by volume fraction of a retained γ phase with a martensite phase being as the dominant phase.

WO2010/134498 proposes a high-strength stainless steel which has an excellent corrosion resistance in a high-temperature environment, and has an SSC resistance (sulfide stress-corrosion cracking resistance) at normal temperature. The chemical composition of the stainless steel disclosed in this literature contains more than 16% and not more than 18% of Cr, not less than 1.6% and not more than 4.0% of Mo, not less than 1.5% and not more than 3.0% of Cu, and more than 4.0% and not more than 5.6% of Ni, and satisfies $Cr+Cu+Ni+Mo\geq 25.5$ and $-8\leq 30(C+N)+0.5Mn+Ni+Cu/2+8.2-1.1(Cr+Mo)\leq -4$. The metal micro-structure of this stainless steel contains a martensite phase, 10 to 40% of a ferrite phase, and a retained austenite phase, with a ferrite phase distribution rate being higher than 85%.

DISCLOSURE OF THE INVENTION

However, in the stainless steels disclosed in the above described patent literatures, it is not necessarily easy to stably obtain a desired metal micro-structure, and there may be a case where a desired yield strength is not stably obtained. In the industrial production of stainless steel, time spent for a heat treatment process and a cooling process will be limited in order to improve productivity. Therefore, there may be a case where a high strength not less than 758 MPa is not stably obtained.

It is an object of the present invention to provide a stainless steel for oil wells, which has an excellent high-temperature corrosion resistance and can stably obtain a strength of not less than 758 MPa.

A stainless steel for oil wells of the present invention contains, by mass %, C: not more than 0.05%, Si: not more than 1.0%, Mn: 0.01 to 1.0%, P: not more than 0.05%, S: less than 0.002%, Cr: 16 to 18%, Mo: 1.8 to 3%, Cu: 1.0 to 3.5%, Ni: 3.0 to 5.5%, Co: 0.01 to 1.0%, Al: 0.001 to 0.1%, O: not more than 0.05%, and N: not more than 0.05%, the balance being Fe and impurities, and satisfies Formulas (1) and (2):

$$Cr+4Ni+3Mo+2Cu \geq 44 \quad (1)$$

$$Cr+3Ni+4Mo+2Cu/3 \leq 46 \quad (2)$$

where each symbol of element in Formulas (1) and (2) is substituted by the content (mass %) of a corresponding element.

The above described stainless steel for oil wells may contain, in place of some of Fe, one or more kinds of elements selected from the group consisting of V: not more than 0.3%, Ti: not more than 0.3%, Nb: not more than 0.3%, and Zr: not more than 0.3%. The above described stainless steel for oil wells may contain, in place of some of Fe, one or more kinds of elements selected from the group consisting of W: not more than 1.0%, and rare earth metal (REM): not more than 0.3%. The above described stainless steel for oil wells may contain, in place of some of Fe, one or more kinds of elements selected from the group consisting of Ca: not more than 0.01%, and B: not more than 0.01%.

The metal micro-structure of the above described stainless steel preferably contains, by volume ratio, not less than 10% and less than 60% of a ferrite phase, not more than 10% of a retained austenite phase, and not less than 40% of a martensite phase.

The stainless steel pipe for oil wells according to the present invention is manufactured from the above described stainless steel for oil wells.

The stainless steel pipe for oil wells according to the present invention has a high strength and an excellent high-temperature corrosion resistance and can stably obtain high strength.

BEST MODE FOR CARRYING OUT THE INVENTION

Hereafter, embodiments of the present invention will be described in detail. The present inventors have conducted a survey and analysis and consequently obtained the following findings.

(A) To obtain a stress corrosion cracking resistance (SCC resistance) in a high-temperature environment, it is preferable that Ni, Mo, and Cu besides Cr are contained. To be more specific, an excellent SCC resistance will be obtained in a high-temperature environment when the following Formula (1) is satisfied:

$$Cr+4Ni+3Mo+2Cu \geq 44 \quad (1)$$

where each symbol of element in Formula (1) is substituted by the content (mass %) of a corresponding element.

(B) When the contents of alloy elements such as Cr, Ni, Mo, and Cu increase, it is not likely that a high strength is stably obtained. The variation of strength will be suppressed, and yield strength of not less than 758 MPa will be stably obtained when the following Formula (2) is satisfied:

$$Cr+3Ni+4Mo+2Cu/3 \leq 46 \quad (2)$$

where each symbol of element in Formula (2) is substituted by the content (mass %) of a corresponding element.

(C) Co stabilizes the strength and corrosion resistance. When Formulas (1) and (2) are satisfied, and 0.01 to 1.0% of Co is contained, a stable metal micro-structure will be obtained, and a stable and high strength and an excellent corrosion resistance in a high-temperature environment will be obtained.

The present invention has been completed based on the above described findings. Hereafter, details of the stainless steel for oil wells of the present invention will be described.

[Chemical Composition]

The stainless steel for oil wells according to the present invention has the following chemical composition.

C: not more than 0.05%

Although carbon (C) contributes to increase strength, it produces carbide at the time of tempering. Cr carbide deteriorates the corrosion resistance to high-temperature carbon dioxide gas. Therefore, the C content is preferably smaller. The C content is not more than 0.05%. Preferably the C content is less than 0.05%, more preferably not more than 0.03%, and even more preferably not more than 0.01%.

Si: not more than 1.0%

Silicon (Si) deoxidizes steel. However, an excessive Si content will deteriorate hot workability. Moreover, it increases the amount of ferrite to be produced, thereby reducing yield strength (yield stress). Therefore, the Si content is not more than 1.0%. Preferably the Si content is not more than 0.8%, more preferably not more than 0.5%, and even more preferably not more than 0.4%. When the Si content is not less than 0.05%, Si acts in a particularly effective manner as a deoxidizer. However, even when the Si content is less than 0.05%, Si deoxidizes steel to some extent.

Mn: 0.01 to 1.0%

Manganese (Mn) deoxidizes and desulfurizes steel, thereby improving hot workability. However, an excessive Mn content is likely to cause segregations in steel, thereby deteriorating the toughness and the SCC resistance in a high-temperature chloride aqueous solution. Moreover, Mn is an austenite forming element. Therefore, when steel contains Ni and Cu which are austenite forming elements, an excessive Mn content will lead to an increase of retained austenite, thereby reducing the yield strength (yield stress). Therefore, the Mn content is 0.01 to 1.0%. The lower limit of Mn content is preferably 0.03%, more preferably 0.05%, and even more preferably 0.07%. The upper limit of Mn content is preferably 0.5%, more preferably less than 0.2%, and even more preferably 0.14%.

P: not more than 0.05%

Phosphor (P) is an impurity. P deteriorates the sulfide stress-corrosion cracking resistance (SSC resistance) and the SCC resistance in a high-temperature chloride aqueous solution environment of steel. Therefore, the P content is preferably as low as possible. The P content is not more than 0.05%. Preferably the P content is less than 0.05%, more preferably not more than 0.025%, and even more preferably not more than 0.015%.

S: less than 0.002%

Sulfur (S) is an impurity. S deteriorates hot workability of steel. The metal micro-structure of a stainless steel of the present invention becomes a two-phase micro-structure including a ferrite phase and an austenite phase during hot working. S deteriorates hot workability of such two-phase micro-structure. Further, S combines with Mn etc. to form inclusions. The inclusions formed act as a starting point of pitting and SCC, thereby deteriorating the corrosion resistance of steel. Therefore, the S content is preferably as low as possible. The S content is less than 0.002%. Preferably the S content is not more than 0.0015%, and more preferably not more than 0.001%.

Cr: 16 to 18%

Chromium (Cr) improves the SCC resistance in a high-temperature chloride aqueous solution environment. However, since Cr is a ferrite forming element, an excessive Cr content will lead to an excessive increase in the amount of ferrite in steel, thereby deteriorating the yield strength of steel. Therefore, Cr content is 16 to 18%. The lower limit of Cr content is preferably more than 16%, more preferably 16.3%, and even more preferably 16.5%. The upper limit of Cr content is preferably less than 18%, more preferably 17.8%, and even more preferably 17.5%.

Mo: 1.8 to 3%

When the production of fluid is temporarily stopped in an oil well, the temperature of the fluid in an oil well pipe will decline. At this moment, the sulfide stress-corrosion cracking susceptibility of a high-strength material generally increases. Molybdenum (Mo) improves the sulfide stress-corrosion cracking susceptibility. Further, Mo improves the SCC resistance of steel under coexistence with Cr. However, since Mo is a ferrite forming element, an excessive Mo content will lead to an increase of the amount of ferrite in steel, thereby reducing the strength of steel. Therefore, the Mo content is 1.8 to 3%. The lower limit of Mo content is preferably more than 1.8%, more preferably 2.0%, and even more preferably 2.1%. The upper limit of Mo content is preferably less than 3%, more preferably 2.7%, and even more preferably 2.6%.

Cu: 1.0 to 3.5%

Cupper (Cu) strengthens a ferrite phase by age precipitation, thereby increasing the strength of steel. Further, Cu reduces the dissolution rate of steel in a high-temperature chloride aqueous solution environment, thereby improving the corrosion resistance of steel. However, an excessive Cu content will lead to a deterioration of the hot workability of steel, thereby deteriorating the toughness of steel. Therefore, the Cu content is 1.0 to 3.5%. The lower limit of Cu content is preferably more than 1.0%, more preferably 1.5%, and even more preferably 2.2%. The upper limit of Cu content is less than 3.5%, more preferably 3.2%, and even more preferably 3.0%.

Ni: 3.0 to 5.5%

Since nickel (Ni) is an austenite forming element, it stabilizes austenite at high temperature and increases the amount of martensite at normal temperature. Therefore, Ni increases the strength of steel. Further, Ni improves the corrosion resistance in a high-temperature chloride aqueous solution environment. However, an excessive Ni content tends to lead to an increase of retained γ phase, and it becomes difficult to stably obtain a high strength especially at the time of industrial production. Therefore, the Ni content is 3.0 to 5.5%. The lower limit of Ni content is preferably more than 3.0%, more preferably 3.5%, even more preferably 4.0%, and even more preferably 4.2%. The upper limit of Ni content is preferably less than 5.5%, more preferably 5.2%, and even more preferably 4.9%.

Co: 0.01 to 1.0%

Cobalt (Co) improves the hardenability of steel, and ensures a stable and high strength especially at the time of industrial production. To be more specific, Co suppresses retained austenite, thereby suppressing the variation of strength. However, an excessive Co content will lead to a deterioration of the toughness of steel. Therefore, the Co content is 0.01 to 1.0%. The lower limit of Co content is preferably more than 0.01%, more preferably 0.02%, even more preferably 0.1%, and even more preferably 0.25%. The upper limit of Co content is preferably less than 1.0%, more preferably 0.95%, and even more preferably 0.75%.

Al: 0.001 to 0.1%

Aluminum (Al) deoxidizes steel. However, an excessive Al content will lead to an increase of the amount of ferrite in steel, thereby deteriorating the strength of steel. Further, a large amount of alumina-based inclusions are produced in steel, thereby deteriorating the toughness of steel. Therefore, the Al content is 0.001 to 0.1%. The lower limit of Al content is preferably more than 0.001%, and more preferably 0.01%. The upper limit of Al content is preferably less than 0.1%, and more preferably 0.06%.

As used herein, the term "Al content" means the content of acid-soluble Al (sol. Al).

O (Oxygen): not more than 0.05%

Oxygen (O) deteriorates the toughness and corrosion resistance of steel. Therefore, the O content is preferably lower. The O content is not more than 0.05%. Preferably the O content is less than 0.05%, more preferably not more than 0.01%, and even more preferably not more than 0.005%.

N: not more than 0.05%

Nitrogen (N) increases the strength of steel. Further, N stabilizes austenite, thereby improving pitting resistance. When even a small amount of N is contained, the above described effects can be obtained to some extent. On the other hand, an excessive N content will lead to a production of a large amount of nitrides in steel, thereby deteriorating the toughness of steel. Further, austenite becomes more likely to be retained, thereby reducing the strength of steel. Therefore, the N content is not more than 0.05%. The lower limit of N content is preferably 0.002%, and more preferably 0.005%. The upper limit of N content is preferably 0.03%, more preferably 0.02%, even more preferably 0.015%, and even more preferably 0.010%.

The balance of the chemical composition of a stainless steel for oil wells is made up of impurities. The term "an impurity" as used herein refers to an element which is mixed from ores and scraps which are used as the starting material of steel, or the environments in the manufacturing process, etc.

[Regarding Selective Elements]

An stainless steel for oil wells may further contain, in place of some of Fe, one or more kinds of elements selected from the group consisting of V: not more than 0.3%, Ti: not more than 0.3%, Nb: not more than 0.3%, and Zr: not more than 0.3%.

V: not more than 0.3%,

Nb: not more than 0.3%,

Ti: not more than 0.3%, and

Zr: not more than 0.3%.

Vanadium (V), niobium (Nb), titanium (Ti), and zirconium (Zr) are all selective elements. Any of these elements forms carbide and increases the strength and toughness of steel. Further, these elements immobilize C and thereby suppress Cr carbide from being produced. For that reason, the pitting resistance of steel is improved, and the SCC susceptibility is reduced. When these elements are contained even in a small amount, the above described effects are obtained to some extent. On the other hand, when the contents of these elements are excessively large, carbides are coarsened and thereby the toughness and the corrosion resistance of steel deteriorate. Therefore, the V content, Nb content, Ti content, and Zr content are not more than 0.3%, respectively. The lower limits of V, Nb, Ti, and Zr are preferably 0.005%, respectively. The upper limits of V, Nb, Ti, and Zr are preferably less than 0.3%, respectively.

A stainless steel for oil wells may contain, in place of some of Fe, one or more kinds of elements selected from the group consisting of W: not more than 1.0% and rare earth metal (REM): not more than 0.3%.

W: not more than 1.0%

REM: not more than 0.3%

Tungsten (W) and rare earth metal (REM) are both selective elements. Herein, the term "REM" refers to one or more kinds of elements selected from the group consisting of yttrium (Y) of atomic number 39, lanthanum (La) of atomic number 57 to lutetium (Lu) of atomic number 71 which are lanthanoid elements, and actinium (Ac) of atomic number 89 to lawrencium (Lr) of atomic number 103, which are actinoid elements.

W and REM both improve the SCC resistance in a high-temperature environment. When these elements are contained even in a small amount, the above described effect will be achieved to some extent. On the other hand, when the contents of these elements are excessively large, the effects thereof will be saturated. Therefore, the W content is not more than 1.0% and the REM content is not more than 0.3%. When REM includes a plurality of elements selected from the above described group, the REM content means a total content of those elements. The lower limit of W content is preferably 0.01%. The lower limit of REM content is preferably 0.001%.

A stainless steel for oil wells may contain, in place of some of Fe, one or more kinds of elements selected from the group consisting of Ca: not more than 0.01% and B: not more than 0.01%.

Ca: not more than 0.01%

B: not more than 0.01%

Calcium (Ca) and boron (B) are both selective elements. A stainless steel for oil wells during hot working has a two-phase micro-structure of ferrite and austenite. For that reason, flaws and defects may be produced in the stainless steel due to hot working. Ca and B suppress flaws and defects from been produced during hot working. When these elements are contained even in a small amount, the above described effect will be obtained to some extent.

On the other hand, an excessive Ca content will lead to an increase of inclusions in steel, thereby deteriorating the toughness and corrosion resistance of steel. Further, an excessive B content will lead to a precipitation of carboboride at grain boundaries, thereby deteriorating the toughness of steel. Therefore, the Ca content and B content are both not more than 0.01%.

The lower limits of Ca content and B content are both preferably 0.0002%. In this case, the above described effect will be remarkably obtained. The upper limits of Ca content and B content are both preferably less than 0.01%, and are both more preferably 0.005%.

[Regarding Formulas (1) and (2)]

The chemical composition of the stainless steel for oil wells further satisfies Formulas (1) and (2):

$$Cr+4Ni+3Mo+2Cu \geq 44 \quad (1)$$

$$Cr+3Ni+4Mo+2Cu/3 \leq 46 \quad (2)$$

where each symbol of element in Formulas (1) and (2) is substituted by the content (%) of a corresponding element.

[Regarding Formula (1)]

Definition is made as F1=Cr+4Ni+3Mo+2Cu. As F1 increases, the SCC resistance in a high-temperature oil well environment will be improved. When the value of F1 is not less than 44, an excellent SCC resistance will be obtained in a high-temperature oil well environment of 150° C. to 200° C. The value of F1 is preferably not less than 45, and more preferably not less than 48. A sufficient SCC resistance at room temperature is also ensured if the value of F1 is not less than 44.

The upper limit of the value of F1 will not be particularly limited. However, when the value of F1 exceeds 52, it becomes difficult to satisfy Formula (2), and thereby the stability of yield strength deteriorates.

[Regarding Formula (2)]

A definition is made as F2=Cr+3Ni+4Mo+2Cu/3. In the stainless steel pipe for oil wells of the present invention, the above described Co is contained and the value of F2 is made not more than 46 to stably secure the strength. When the value of F2 exceeds 46, a retained austenite is excessively formed, and it becomes difficult to stably secure the yield strength.

The value of F2 is preferably not more than 44, more preferably not more than 43, and even more preferably not more than 42. The lower limit of the value of F2 is not particularly limited. However, when the value of F2 is not more than 36, there will be a case where the value of F1 is not likely to become not less than 44.

[Relation Between C and N]

The chemical composition of a stainless steel for oil wells preferably satisfies Formula (3):

$$2.7C+N \leq 0.060 \quad (3)$$

where C and N in Formula (3) are substituted by the C content (%) and N content (%), respectively.

A definition is made as F3=2.7C+N. When the value of F3 is not more than 0.060, a retained austenite is further suppressed from being produced. Therefore, combined with the effect of Formula (2), it is possible to secure the strength more stably. The value of F3 is preferably not more than 0.050, and more preferably not more than 0.045.

[Metal Micro-Structure]

The metal micro-structure of a stainless steel for oil wells preferably contains, by volume ratio, less than 10 to 60% of a ferrite phase, not more than 10% of a retained austenite phase, and a martensite phase.

Ferrite phase: not less than 10% and less than 60% by volume ratio

The stainless steel for oil wells of the present invention has large contents of Cr and Mo which are ferrite forming elements. On the other hand, although Ni is contained in the view point of stabilizing austenite at high temperature and securing martensite at normal temperature, the content of Ni which is an austenite forming element, is suppressed to a level at which the amount of retained austenite is not excessive. Therefore, the stainless steel of the present invention will not be a martensite single-phase micro-structure at normal temperature, and will be a mixed micro-structure including at least a martensite phase and a ferrite phase at normal temperature. While a martensite phase in the metal micro-structure contributes to an increase in strength, an excessive volume ratio of ferrite phase will deteriorate the strength of steel. Therefore, the volume ratio of ferrite phase is preferably not less than 10% and less than 60%. The lower limit of the volume ratio of ferrite phase is preferably more than 10%, more preferably 12%, and even more preferably 14%. The upper limit of the volume ratio of ferrite phase is preferably 48%, more preferably 45%, and even more preferably 40%.

The volume ratio of ferrite phase is determined by the following method. A sample is taken from an arbitrary location of a stainless steel. In the sample taken, a sample surface which corresponds to a cross section of the stainless steel is ground. After grinding, the ground sample surface is etched by using a mixed solution of aqua regia and glycerin. The area fraction of ferrite phase on the etched surface is measured by a point counting method conforming to JIS G0555 by using an optical microscope (observation magnifications of 100). The measured area fraction is defined as a volume ratio of ferrite phase.

Retained austenite phase: not more than 10% by volume ratio

A small amount of retained austenite will not cause a remarkable decline of strength, and will remarkably improve the toughness of steel. However, an excessive volume ratio of retained austenite will lead to a remarkable decline of the strength of steel. Therefore, the volume ratio of retained austenite phase is not more than 10%. From view point of securing strength, a more preferable volume ratio of retained austenite phase is not more than 8%.

When the volume ratio of retained austenite phase is not less than 0.5%, the above described effect of improving toughness will be obtained effectively. However, even if the volume ratio of retained austenite phase is less than 0.5%, the above described effect will be obtained to some extent.

The volume ratio of retained austenite phase is determined by an X-ray diffraction method. To be specific, a sample is taken from an arbitrary location of a stainless steel. The size of the sample is 15 mm×15 mm×2 mm. Respective X ray intensities of the (200) and (211) planes of ferrite phase (α phase), and (200), (220), and (311) planes of retained austenite phase (γ phase) are measured by using a sample. Then, the integrated intensity of each plane is calculated. After the calculation, a volume ratio of retained austenite phase Vγ(%) is calculated for each of combinations (a total of 6 combinations) of each plane of the α phase and each plane of the γ phase by using Formula (1). Then, an average value of volume ratios Vγ of 6 combinations is defined as the volume ratio (%) of retained austenite.

$$V\gamma=100/(1+(I\alpha\times R\gamma)/(I\gamma\times R\alpha)) \quad (1)$$

Where "Iα" is the integrated intensity of α phase. "Rα" is a crystallographic theoretical calculation value of α phase. "Iγ" is the integrated intensity of γ phase. "Rγ" is a crystallographic theoretical calculation value of γ phase.

Martensite phase: Balance

In the metal micro-structure of a stainless steel of the present invention, the portions other than the above described ferrite phase and the retained austenite phase are predominantly a tempered martensite phase. To be more specific, the metal micro-structure of the stainless steel of the present invention preferably contains not less than 40% by volume ratio of a martensite phase. The lower limit of the volume ratio of martensite is more preferably 48%, and even more preferably 52%. The volume ratio of martensite phase is determined by subtracting the volume ratios of ferrite phase and retained austenite phase, which are determined by the above described method, from 100%.

The metal micro-structure of a stainless steel for oil wells may contain precipitates and/or inclusions such as carbides, nitrides, borides, and a Cu phase besides a ferrite phase, a retained austenite phase, and a martensite phase.

[Manufacturing Method]

A method for manufacturing a seamless steel pipe will be described as one example of a method for manufacturing a stainless steel for oil wells.

A starting material having the above described chemical composition is prepared. The starting material may be a cast piece manufactured by a continuous casting method (including a round CC). Moreover, it may be a billet manufactured by hot working an ingot manufactured by an ingot-making process. It may also be a billet manufactured from the cast piece.

The prepared starting material is charged into a reheating furnace or a soaking pit to be heated. Next, the heated starting material is subjected to hot working to manufacture a hollow shell. For example, a Mannesmann process is performed as hot working. To be specific, the starting material is piercing-rolled by a piercing machine to be formed into a hollow shell. Next, the hollow shell is further rolled, for example, by a mandrel mill and a sizing mill. As hot working, hot extrusion may be performed, or hot forging may be performed.

It is preferable that the reduction of area of a starting material while the temperature of the starting material is 850 to 1250° C. is not less than 50% during hot working. In the range of the chemical composition of the steel of the present invention, performing hot working such that the reduction of area of the starting material while the temperature of the starting material is 850 to 1250° C. is not less than 50% will result in that a micro-structure including a martensite phase and a ferrite phase which is long-stretched (for example, about 50 to 200 μm) in the rolling direction is formed in the near-surface portion of steel. Since a ferrite phase is more likely to contain Cr etc. than a martensite, it effectively contributes to the prevention of the propagation of SCC at high temperature. As so far described, when the ferrite phase is long-stretched in the rolling direction, even if SCC occurs on the surface at high temperature, it becomes more likely to reach the ferrite phase during the course of the propagation of crack. For this reason, SCC resistance at high temperature improves.

The hollow shell after hot working is cooled to normal temperature. The cooling method may be either air cooling or water cooling. Since in a stainless steel of the present invention, martensite transformation will occur when it is cooled to or lower than a Ms point even by air cooling, it is possible to obtain a mixed micro-structure including martensite and ferrite. However, when attempting to stably secure a high strength of not less than 758 MPa, particularly a high strength of not less than 862 MPa, it is preferable that the hot rolled hollow shell is air cooled, thereafter reheated to not lower than an $A_{c3}$ transformation point, and is quenched by performing water cooling such as a dipping method and a spray method.

Although decreasing the value of F2 or increasing the Co content may make it possible to obtain a high strength even by air cooling, there may be a lack of stability in strength. To stably obtain a high strength, the steel is cooled by water cooling till the surface temperature of the hollow shell becomes not more than 60° C. That is, the hollow shell after hot working is preferably water cooled and a water-cooling stopping temperature is made not more than 60° C. The water-cooling stopping temperature is more preferably not more than 45° C., and even more preferably not more than 30° C.

The quenched hollow shell is tempered at not more than an $A_{c1}$ point so that the yield strength is adjusted to be not less than 758 MPa. When the tempering temperature exceeds the $A_{c1}$ point, the volume ratio of retained austenite sharply increases, and the strength deteriorates.

The high-strength stainless steel for oil wells manufactured by the above described processes has a yield stress of not less than 758 MPa, and has an excellent corrosion resistance even in a high-temperature oil well environment of 200° C. owing to the effects of Cr, Mo, Ni, and Cu contained therein.

EXAMPLES

Steels of marks 1 to 28 having chemical compositions shown in Table 1 were melted, and cast pieces were manufactured by a continuous casting.

TABLE 1

| | Chemical Composition (in mass %, the balance being Fe and impurities) | | | | | | | | | | | | |
|---|---|---|---|---|---|---|---|---|---|---|---|---|---|
| Mark | C | Si | Mn | P | S | Cr | Mo | Cu | Ni | Co | Al | O | N |
| 1 | 0.008 | 0.20 | 0.11 | 0.012 | 0.0012 | 16.28 | 2.82 | 3.44 | 4.85 | 0.230 | 0.040 | 0.0017 | 0.0122 |
| 2 | 0.013 | 0.26 | 0.20 | 0.010 | 0.0012 | 17.41 | 2.34 | 1.32 | 5.44 | 0.202 | 0.045 | 0.0020 | 0.0151 |
| 3 | 0.008 | 0.45 | 0.09 | 0.015 | 0.0008 | 17.02 | 1.98 | 3.38 | 3.65 | 0.628 | 0.033 | 0.0016 | 0.0100 |
| 4 | 0.011 | 0.32 | 0.08 | 0.023 | 0.0010 | 17.66 | 2.43 | 2.67 | 5.17 | 0.073 | 0.038 | 0.0021 | 0.0099 |
| 5 | 0.017 | 0.23 | 0.07 | 0.019 | 0.0012 | 16.50 | 2.53 | 3.35 | 4.38 | 0.156 | 0.039 | 0.0017 | 0.0211 |
| 6 | 0.032 | 0.42 | 0.29 | 0.017 | 0.0014 | 16.75 | 2.12 | 1.90 | 4.50 | 0.185 | 0.051 | 0.0016 | 0.0102 |
| 7 | 0.016 | 0.40 | 0.14 | 0.018 | 0.0012 | 17.50 | 2.69 | 2.60 | 4.99 | 0.050 | 0.032 | 0.0011 | 0.0084 |
| 8 | 0.031 | 0.47 | 0.10 | 0.012 | 0.0014 | 17.32 | 2.61 | 3.12 | 4.48 | 0.072 | 0.027 | 0.0014 | 0.0090 |
| 9 | 0.019 | 0.30 | 0.07 | 0.015 | 0.0012 | 16.20 | 2.81 | 3.22 | 4.30 | 0.150 | 0.037 | 0.0016 | 0.0084 |
| 10 | 0.018 | 0.33 | 0.32 | 0.017 | 0.0013 | 17.10 | 2.40 | 3.30 | 4.50 | 0.130 | 0.033 | 0.0015 | 0.0124 |
| 11 | 0.012 | 0.37 | 0.09 | 0.012 | 0.0014 | 16.08 | 2.04 | 2.72 | 4.24 | 0.110 | 0.028 | 0.0018 | 0.0077 |
| 12 | 0.025 | 0.27 | 0.08 | 0.011 | 0.0010 | 16.57 | 2.07 | 2.94 | 4.38 | 0.340 | 0.038 | 0.0015 | 0.0090 |
| 13 | 0.022 | 0.25 | 0.09 | 0.018 | 0.0013 | 16.26 | 2.37 | 2.71 | 4.70 | 0.520 | 0.026 | 0.0010 | 0.0079 |
| 14 | 0.016 | 0.39 | 0.07 | 0.010 | 0.0018 | 17.75 | 2.02 | 1.88 | 5.01 | 0.240 | 0.027 | 0.0019 | 0.0085 |
| 15 | 0.017 | 0.27 | 0.08 | 0.014 | 0.0009 | 17.17 | 2.06 | 2.39 | 4.12 | 0.014 | 0.029 | 0.0015 | 0.0084 |
| 16 | 0.007 | 0.34 | 0.15 | 0.019 | 0.0015 | 16.52 | 2.34 | 2.26 | 4.50 | 0.031 | 0.032 | 0.0020 | 0.0080 |
| 17 | 0.026 | 0.35 | 0.12 | 0.014 | 0.0012 | 17.22 | 2.43 | 1.91 | 5.30 | 0.189 | 0.038 | 0.0016 | 0.0072 |
| 18 | 0.018 | 0.27 | 0.06 | 0.012 | 0.0017 | 17.50 | 2.15 | 3.32 | 4.25 | 0.152 | 0.044 | 0.0018 | 0.0095 |
| 19 | 0.010 | 0.32 | 0.09 | 0.014 | 0.0016 | 16.82 | 2.61 | 2.89 | 4.20 | 0.173 | 0.043 | 0.0012 | 0.0073 |
| 20 | 0.014 | 0.34 | 0.09 | 0.016 | 0.0013 | 16.57 | 2.19 | 2.41 | 4.92 | 0.058 | 0.026 | 0.0010 | 0.0090 |
| 21 | 0.022 | 0.30 | 0.55 | 0.011 | 0.0011 | 17.30 | 2.90 | 1.71 | 4.75 | —* | 0.039 | 0.0020 | 0.0077 |
| 22 | 0.025 | 0.25 | 0.35 | 0.015 | 0.0017 | 17.50 | 2.76 | 2.55 | 4.98 | 0.005* | 0.025 | 0.0023 | 0.0093 |
| 23 | 0.013 | 0.26 | 0.15 | 0.014 | 0.0015 | 16.41 | 2.52 | 1.79 | 4.47 | 1.211* | 0.025 | 0.0019 | 0.0083 |
| 24 | 0.023 | 0.32 | 0.48 | 0.013 | 0.0015 | 16.20 | 2.20 | 2.85 | 3.30 | 0.097 | 0.020 | 0.0011 | 0.0113 |
| 25 | 0.017 | 0.28 | 0.19 | 0.017 | 0.0016 | 17.60 | 2.80 | 3.40 | 5.30 | 0.050 | 0.036 | 0.0016 | 0.0091 |
| 26 | 0.015 | 0.33 | 0.11 | 0.012 | 0.0013 | 17.52 | 2.92 | 3.41 | 5.42 | 0.032 | 0.035 | 0.0017 | 0.0078 |
| 27 | 0.012 | 0.27 | 0.15 | 0.013 | 0.0013 | 17.62 | 2.77 | 3.45 | 5.39 | 0.017 | 0.041 | 0.0025 | 0.0063 |
| 28 | 0.025 | 0.47 | 0.58 | 0.012 | 0.0014 | 17.55 | 2.88 | 3.38 | 5.10 | 0.250 | 0.027 | 0.0014 | 0.0090 |

| | Chemical Composition (in mass %, the balance being Fe and impurities) | | | | | | | | | | |
|---|---|---|---|---|---|---|---|---|---|---|---|
| Mark | V | Ti | Nb | Zr | W | REM | Ca | B | F1 | F2 | F3 |
| 1 | — | — | — | — | — | — | — | — | 51.0 | 44.4 | 0.033 |
| 2 | — | — | — | — | — | — | — | — | 48.8 | 44.0 | 0.051 |
| 3 | — | — | — | — | — | — | — | — | 44.3 | 38.1 | 0.033 |
| 4 | — | — | — | — | — | — | — | — | 51.0 | 44.7 | 0.039 |
| 5 | — | — | — | — | — | — | — | — | 48.3 | 42.0 | 0.067 |
| 6 | — | — | — | — | — | — | — | — | 44.9 | 40.0 | 0.097 |
| 7 | — | — | — | — | — | — | — | — | 50.7 | 45.0 | 0.053 |
| 8 | — | — | — | — | — | — | — | — | 49.3 | 43.3 | 0.093 |
| 9 | 0.28 | — | — | — | — | — | — | — | 48.3 | 42.5 | 0.059 |
| 10 | | 0.26 | — | — | — | — | — | — | 48.9 | 42.4 | 0.061 |
| 11 | 0.17 | — | 0.24 | — | — | — | — | — | 44.6 | 38.8 | 0.039 |
| 12 | — | — | — | 0.25 | 0.47 | — | — | — | 46.2 | 39.9 | 0.077 |
| 13 | — | — | — | — | — | — | — | — | 47.6 | 41.7 | 0.067 |
| 14 | — | 0.18 | 0.15 | — | — | La: 0.23 | — | — | 47.6 | 42.1 | 0.051 |
| 15 | — | — | — | — | — | — | 0.008 | — | 44.6 | 39.4 | 0.055 |
| 16 | — | — | — | — | — | — | | 0.0009 | 46.1 | 40.9 | 0.027 |
| 17 | — | — | — | — | — | — | 0.005 | 0.0008 | 49.5 | 44.1 | 0.077 |
| 18 | 0.23 | — | — | 0.18 | 0.16 | — | 0.003 | — | 47.6 | 41.1 | 0.059 |
| 19 | — | 0.18 | 0.11 | — | — | Ce: 0.28 | — | 0.0007 | 47.2 | 41.8 | 0.034 |
| 20 | 0.17 | — | — | — | 0.38 | Nd: 0.17 | 0.002 | 0.0009 | 47.6 | 41.7 | 0.047 |
| 21 | — | — | — | — | — | — | — | — | 48.4 | 44.3 | 0.067 |
| 22 | — | — | — | — | — | — | — | — | 50.8 | 45.2 | 0.077 |
| 23 | — | — | — | — | — | — | — | — | 45.4 | 41.1 | 0.044 |
| 24 | — | — | — | — | — | — | — | — | 41.7* | 36.8 | 0.073 |
| 25 | — | — | — | — | — | — | — | — | 54.0 | 47.0* | 0.055 |
| 26 | — | — | — | — | — | — | — | — | 54.8 | 47.7* | 0.048 |
| 27 | — | — | — | — | — | — | — | — | 54.4 | 47.2* | 0.039 |
| 28 | — | — | — | — | — | — | — | — | 53.4 | 46.6* | 0.077 |

Numerals marked with "*" mean that their values are out of the range of the present invention.

Referring to Table 1, the steels of marks 1 to 20 fell into the range of the present invention. On the other hand, the chemical compositions of marks 21 to 28 were out of the range of the present invention.

The cast piece of each mark was rolled by a blooming mill to manufacture a round billet. The round billet of each steel had a diameter of 232 mm. Then, the outer surface of each round billet was cut such that the diameter of the round billet was 225 mm.

Each round billet was heated to 1150 to 1200° C. in a reheating furnace. After heating, each round billet was hot rolled. To be specific, the round billet was piercing-rolled by a piercing machine to manufacture a hollow shell. The hollow shell was drawn and rolled by a mandrel mill, and was further reduced in diameter such that the outer diameter of the hollow shell was 196.9 to 200 mm and the wall thickness was 15 to 40 mm. All the cooling of the hollow shell after hot rolling was performed by spontaneous cooling.

Quenching was performed on the hollow shell after it was allowed to cool. To be specific, the hollow shell was charged into a heat treatment furnace to be soaked at 980° C. for 20 minutes. The hollow shell after soaking was water cooled by a spray method to be quenched. The hollow shell after quenching was soaked at a tempering temperature of 550° C. for 30 minutes to be tempered.

Through the above described processes, a plurality of seamless steel pipes of plural sizes were manufactured at each mark.

The manufactured seamless steel pipes were used to perform the following evaluation tests.

[Tensile Test]

Round bar specimens (dia. 6.35 mm×GL 25.4 mm) conforming to API specification were taken from a plurality of seamless steel pipes of each mark. The tensile direction of the round bar specimen was set to a pipe axis direction of the seamless steel pipe. By using the prepared round bar specimens, tensile tests were conducted at normal temperature (25° C.) conforming to API specification.

After the tensile test, among the plurality of seamless steel pipes of each mark, the seamless steel pipe having a maximum yield stress at each mark (hereafter, referred to as a high YS material) and the seamless steel pipe having a minimum yield stress (hereafter, referred to as a low YS material) were selected. The high YS material and the low YS material of each mark were used to perform the following evaluation test.

[Metal Micro-Structure Observation]

Samples for micro-structure observation were taken from arbitrary locations of the high YS material and the low YS material of each mark. In a sample taken, a sample surface of a cross section normal to the axial direction of the seamless steel pipe was ground. After grinding, the ground sample surface was etched by using a mixed solution of aqua regia and glycerin. The area ratio of ferrite phase on the etched surface was measured by the point counting method conforming to JIS G0555. The measured area ratio was defined as the volume ratio of ferrite phase.

Further, the volume ratio of retained austenite phase was determined by the above described X-ray diffraction method. Furthermore, based on the determined volume ratios of ferrite phase and retained austenite phase, the volume ratio of martensite phase was determined by the above described method.

[Toughness Test]

Full size specimens (L direction) conforming to ASTM E23 were taken from a high YS material and low YS material of each mark. The Charpy impact test was performed by using the full size specimen to determine an absorbed energy at −10° C.

[High-Temperature Corrosion Resistance Test]

Four-point bending test specimens were taken from a high YS material and low YS material of each mark. The specimen had a length of 75 mm, a width of 10 mm, and a thickness of 2 mm. Each specimen was given a deflection by four-point bending. In this occasion, the deflection amount of each specimen was determined conforming to ASTM G39 such that the stress given to the specimen is equal to the yield stress of the specimen.

An autoclave of 200° C. in which $CO_2$ of 30 bar and $H_2S$ of 0.01 bar were sealed under pressure was prepared. Each specimen subjected to a deflection was stored in each autoclave. Each specimen was immersed in an aqueous solution containing 25 wt % NaCl+0.41 g/L $CH_3COONa$ (pH=4.5 in $CH_3COONa$+$CH_3COOH$ buffer system) in each autoclave for one month.

After 720 h immersion, the occurrence or nonoccurrence of stress corrosion cracking (SCC) was investigated on each specimen. To be specific, the cross section of a portion of each specimen to which tensile stress is applied was observed by an optical microscope having a visual field of 100 magnifications to determine the presence or absence of a crack.

Further, the weight of the specimen before and after the test was measured. A corrosion loss of each specimen was determined based on the amount of change in the measured weight. From the corrosion loss, an annual corrosion loss (mm/y) was calculated.

[SSC Resistance Test at Normal Temperature]

Round bar specimens for NACE TM0177 METHOD A were taken from a high YS material and low YS material of each mark. The sizes of the specimen were 6.35 mm in diameter and 25.4 mm in GL. A tensile stress was applied to each specimen in its axial direction. At this moment, in conformity to NACE TM0177-2005, the deflection amount of each specimen was determined such that the stress given to each specimen was 90% of the yield stress (actual measurement) of each specimen.

The test bath was a 25 wt % aqueous solution of NaCl in which 0.01 bar of $H_2S$ and 0.99 bar of $CO_2$ were saturated. The pH of the test bath was regulated to be 4.0 by a $CH_3COONa/CH_3COOH$ buffer solution containing 0.41 g/L of $CH_3COONa$. The temperature of the test bath was 25° C.

A round bar specimen was immersed in the above described test bath for 720 hours. After immersion, determination was made on whether or not cracking (SSC) occurred in each specimen by the same method as in the high-temperature corrosion resistance test.

[Investigation Results]

Table 2 shows the test results.

TABLE 2

| | Low YS Materials | | | | | | | High YS Materials | | | | | | |
|---|---|---|---|---|---|---|---|---|---|---|---|---|---|---|
| | YS | F | M | A | Toughness | Corrosion Resistance | | YS | F | M | A | Toughness | Corrosion Resistance | |
| Mark | (MPa) | (vol. %) | (vol. %) | (vol. %) | (J) | SCC | SSC | (MPa) | (vol. %) | (vol. %) | (vol. %) | (J) | SCC | SSC |
| 1 | 889 | 30 | 68 | 2 | ≥150 | NF | NF | 939 | 29 | 70 | 1 | ≥150 | NF | NF |
| 2 | 834 | 43 | 54 | 3 | ≥150 | NF | NF | 875 | 39 | 56 | 5 | ≥150 | NF | NF |

TABLE 2-continued

| | Low YS Materials | | | | | | | High YS Materials | | | | | | |
|---|---|---|---|---|---|---|---|---|---|---|---|---|---|---|
| | YS | F | M | A | Tough-ness | Corrosion Resistance | | YS | F | M | A | Tough-ness | Corrosion Resistance | |
| Mark | (MPa) | (vol. %) | (vol. %) | (vol. %) | (J) | SCC | SSC | (MPa) | (vol. %) | (vol. %) | (vol. %) | (J) | SCC | SSC |
| 3 | 916 | 42 | 56 | 2 | ≥150 | NF | NF | 974 | 38 | 61 | 1 | ≥150 | NF | NE |
| 4 | 868 | 45 | 54 | 1 | ≥150 | NF | NF | 903 | 36 | 63 | 1 | ≥150 | NF | NF |
| 5 | 792 | 33 | 59 | 8 | ≥150 | NF | NF | 817 | 29 | 69 | 2 | ≥150 | NF | NF |
| 6 | 792 | 38 | 55 | 7 | ≥150 | NF | NF | 813 | 34 | 59 | 7 | ≥150 | NF | NF |
| 7 | 779 | 47 | 49 | 4 | ≥150 | NF | NF | 830 | 44 | 54 | 2 | ≥150 | NF | NF |
| 8 | 765 | 44 | 48 | 8 | ≥150 | NF | NF | 861 | 42 | 54 | 4 | ≥150 | NF | NF |
| 9 | 813 | 38 | 56 | 6 | ≥150 | NF | NF | 868 | 35 | 61 | 4 | ≥150 | NF | NF |
| 10 | 799 | 36 | 56 | 8 | ≥150 | NF | NF | 826 | 37 | 57 | 6 | ≥150 | NE | NF |
| 11 | 882 | 35 | 63 | 2 | ≥150 | NF | NF | 903 | 33 | 66 | 1 | ≥150 | NF | NF |
| 12 | 772 | 31 | 60 | 9 | ≥150 | NF | NF | 896 | 30 | 67 | 3 | ≥150 | NF | NF |
| 13 | 765 | 34 | 58 | 8 | ≥150 | NF | NF | 792 | 29 | 67 | 4 | ≥150 | NF | NF |
| 14 | 841 | 45 | 52 | 3 | ≥150 | NF | NF | 852 | 43 | 55 | 2 | ≥150 | NF | NF |
| 15 | 847 | 44 | 52 | 4 | ≥150 | NF | NF | 898 | 43 | 56 | 1 | ≥150 | NF | NF |
| 16 | 882 | 39 | 59 | 2 | ≥150 | NF | NF | 923 | 37 | 62 | 1 | ≥150 | NF | NF |
| 17 | 785 | 38 | 54 | 8 | ≥150 | NF | NF | 841 | 37 | 58 | 5 | ≥150 | NF | NF |
| 18 | 813 | 43 | 52 | 5 | ≥150 | NF | NF | 863 | 38 | 59 | 3 | ≥150 | NF | NE |
| 19 | 889 | 43 | 56 | 1 | ≥150 | NF | NF | 965 | 35 | 64 | 1 | ≥150 | NE | NE |
| 20 | 818 | 36 | 58 | 6 | ≥150 | NF | NF | 871 | 31 | 67 | 2 | ≥150 | NF | NF |
| 21 | 696 | 42 | 46 | 12 | ≥150 | NF | NF | 813 | 44 | 49 | 7 | ≥150 | NF | NF |
| 22 | 723 | 41 | 46 | 13 | ≥150 | NF | NF | 779 | 42 | 50 | 8 | ≥150 | NF | NE |
| 23 | 930 | 39 | 60 | 1 | 86 | NF | NF | 971 | 36 | 63 | 1 | 83 | NF | NF |
| 24 | 841 | 37 | 59 | 4 | ≥150 | F | F | 877 | 35 | 63 | 2 | ≥150 | F | F |
| 25 | 668 | 37 | 48 | 15 | ≥150 | NF | NF | 723 | 39 | 50 | 11 | ≥150 | NF | NF |
| 26 | 675 | 40 | 46 | 14 | ≥150 | NF | NF | 737 | 36 | 52 | 12 | ≥150 | NF | NF |
| 27 | 703 | 39 | 49 | 12 | ≥150 | NF | NF | 777 | 38 | 54 | 8 | ≥150 | NF | NF |
| 28 | 682 | 42 | 42 | 16 | ≥150 | NF | NF | 703 | 37 | 50 | 13 | ≥150 | NF | NF |

The "low YS material" column in Table 2 shows evaluation test results using the low YS material of each mark, and the "high YS material" column shows the results using the high YS material. "F" (%) in Table 2 shows the volume ratio (%) of ferrite phase in the metal micro-structure of a corresponding mark, "M" shows the volume ratio (%) of martensite phase, and "A" shows the volume ratio (%) of retained austenite phase, respectively. "NF" in the "SCC" and "SSC" columns of "Corrosion resistance" column shows that SCC or SSC was not observed in a corresponding mark. "F" shows that SCC or SSC was observed in a corresponding mark.

[Regarding Metal Micro-Structure and Yield Strength]

Referring to Table 2, the chemical compositions of the seamless steel pipes of marks 1 to 20 were within the range of the present invention and satisfied Formulas (1) and (2), and the metal micro-structures were also within the range of the present invention. For that reason, the yield strength of any of the seamless steel pipes of each mark was not less than 758 MPa (110 ksi) even in low YS, and thus a yield strength of not less than 110 ksi was stably obtained.

Further, there was a tendency observed that a yield strength of a 125 ksi level was obtained even in low YS materials for marks 1, 3, 4, 11, 16, and 19 for which the left hand side value of Formula (3), that is, the value of F3 was not more than 0.045 among the seamless steel pipes of marks 1 to 20. Moreover, in marks 5, 6, 8, 10, 12, 13, and 17 in which the value of F3 exceeded 0.060, it was recognized in low YS materials that although a yield strength of 110 ksi level was satisfied, there was a tendency observed that the yield strength at the same level of F2 was somewhat lower compared with the case where the value of F3 was not more than 0.0045 at a value of F2 of the same level.

Further, in the seamless steel pipes of marks 1 to 20, the absorption energy at −10° C. was not less than 150 J, exhibiting high toughness. Further, no SCC was observed at the high-temperature corrosion resistance test, and also no SSC was observed in the SSC resistance test at normal temperature.

Note that the corrosion rate was less than 0.10 mm/y in any of marks 1 to 28.

On the other hand, in marks 21 and 22, the Co content was less than the lower limit of Co content of the present invention. For that reason, the yield stress of low YS material became less than 758 MPa, and the volume ratio of retained austenite phase exceeded 10% as well. Therefore, it was not possible to stably obtain a strength not less than 110 ksi.

In mark 23, the Co content exceeded the upper limit of Co content of the present invention. For that reason, both the high YS material and the low YS material had an adsorption energy at −10° C. less than 150 J (83 J in the high YS material and 86 J in the low YS material), exhibiting a low toughness.

Although the content of each element of mark 24 was within the range of the present invention, it did not satisfy Formula (1). For that reason, SSC was observed in the SSC resistance test, exhibiting a low SSC resistance. Moreover, SCC was observed in the high-temperature corrosion resistance test, exhibiting a low high-temperature corrosion resistance.

Although the content of each element of marks 25 to 28 was within the range of the present invention, it did not satisfy Formula (2). For that reason, in all of the low YS materials, the volume ratio of retained austenite phase exceeded 10%, and the yield strength was less than 758 MPa (110 ksi). Although there was a case where the yield strength was not less than 758 MPa as in the high YS material of mark 27, it was clear that when the value of F2 did not satisfy Formula (2), a high strength steel pipe could not be stably manufactured.

Although so far embodiments of the present invention have been described, the above described embodiments are merely examples for carrying out the present invention. Therefore, the present invention will not be limited to the above described embodiments, and can be carried out by appropriately modifying the above described embodiments within a range not departing from the spirit of the invention.

INDUSTRIAL APPLICABILITY

The stainless steel for oil wells according to the present invention can be utilized in oil wells and gas wells. Particularly, it can be used in a deep oil well having a high-temperature environment.

The invention claimed is:

1. A stainless steel for oil wells comprising, by mass %,
C: not more than 0.05%,
Si: not more than 1.0%,
Mn: 0.01 to 1.0%,
P: not more than 0.05%,
S: less than 0.002%,
Cr: 16 to 18%,
Mo: 1.8 to 3%,
Cu: 1.0 to 3.5%,
Ni: 3.0 to 5.5%,
Co: 0.01 to 1.0%,
Al: 0.001 to 0.1%,
O: not more than 0.05%, and
N: not more than 0.05%, the balance being Fe and impurities, and satisfying Formulas (1) and (2):

$$Cr+4Ni+3Mo+2Cu \geq 44 \quad (1)$$

$$Cr+3Ni+4Mo+2Cu/3 \leq 46 \quad (2)$$

where each symbol of element in Formulas (1) and (2) is substituted by a content, in mass %, of a corresponding element.

2. The stainless steel for oil wells according to claim 1, wherein
the stainless steel for oil wells contains, in place of some of Fe, one or more kinds of elements selected from the group consisting of
V: not more than 0.3%,
Ti: not more than 0.3%,
Nb: not more than 0.3%, and
Zr: not more than 0.3%.

3. The stainless steel for oil wells according to claim 1, wherein
the stainless steel for oil wells contains, in place of some of Fe, one or more kinds of elements selected from the group consisting of
W: not more than 1.0%, and
rare earth metal (REM): not more than 0.3%.

4. The stainless steel for oil wells according to claim 2, wherein
the stainless steel for oil wells contains, in place of some of Fe, one or more kinds of elements selected from the group consisting of
W: not more than 1.0%, and
rare earth metal (REM): not more than 0.3%.

5. The stainless steel for oil wells according to claim 1, wherein
the stainless steel for oil wells contains, in place of some of Fe, one or more kinds of elements selected from the group consisting of
Ca: not more than 0.01%, and
B: not more than 0.01%.

6. The stainless steel for oil wells according to claim 2, wherein
the stainless steel for oil wells contains, in place of some of Fe, one or more kinds of elements selected from the group consisting of
Ca: not more than 0.01%, and
B: not more than 0.01%.

7. The stainless steel for oil wells according to claim 3, wherein
the stainless steel for oil wells contains, in place of some of Fe, one or more kinds of elements selected from the group consisting of
Ca: not more than 0.01%, and
B: not more than 0.01%.

8. The stainless steel for oil wells according to claim 4, wherein
the stainless steel for oil wells contains, in place of some of Fe, one or more kinds of elements selected from the group consisting of
Ca: not more than 0.01%, and
B: not more than 0.01%.

9. The stainless steel for oil wells according to claim 1, wherein
a metal micro-structure of the stainless steel for oil wells contains, by volume ratio, not less than 10% and less than 60% of ferrite phase, not more than 10% of retained austenite phase, and not less than 40% of martensite phase.

10. The stainless steel for oil wells according to any one of claims 1 to 8, wherein
the stainless steel for oil wells has a yield strength of not less than 862 MPa.

11. The stainless steel for oil wells according to claim 9, wherein
the stainless steel for oil wells has a yield strength of not less than 862 MPa.

12. An oil well pipe manufactured from the stainless steel for oil wells according to claim 1.

13. An oil well pipe manufactured from the stainless steel for oil wells according to claim 9.

14. An oil well pipe manufactured from the stainless steel for oil wells according to claim 10.

15. An oil well pipe manufactured from the stainless steel for oil wells according to claim 11.

* * * * *